US005144890A

United States Patent [19]

Korhonen

[11] Patent Number: 5,144,890

[45] Date of Patent: Sep. 8, 1992

[54] ACTUATOR OF MODULAR CONSTRUCTION FOR ROLLS OF A MACHINE CALENDER

[75] Inventor: Osmo Korhonen, Karhula, Finland

[73] Assignee: Valmet-Ahlstrom Inc., Karhula, Finland

[21] Appl. No.: 598,884

[22] Filed: Oct. 19, 1990

[30] Foreign Application Priority Data

Oct. 25, 1989 [FI] Finland ..... 895069

[51] Int. Cl.[5] ..... B30B 3/04; D21G 1/00

[52] U.S. Cl. ..... 100/163 A; 100/170

[58] Field of Search ..... 100/160, 161, 162 R, 100/163 R, 163 A, 164, 165, 168, 169, 170

[56] References Cited

U.S. PATENT DOCUMENTS

| | | | |
|---|---|---|---|
| 2,815,531 | 12/1957 | Stewart | 100/163 R X |
| 3,155,029 | 11/1964 | Thomas | 100/170 |
| 3,158,088 | 11/1964 | Seidel | 100/163 R |
| 3,183,826 | 5/1965 | Moore et al. | 100/170 X |
| 3,204,552 | 9/1965 | Beachler et al. | 100/170 |
| 3,554,118 | 1/1971 | Laine | 100/163 A |
| 3,584,570 | 6/1971 | Sass et al. | 100/170 X |
| 3,598,041 | 8/1971 | De Noyer et al. | 100/163 A |
| 3,978,784 | 9/1976 | Bryce et al. | 100/170 |
| 4,501,197 | 2/1985 | Karr et al. | 100/162 R X |
| 4,641,569 | 2/1987 | Smith et al. | 100/163 R X |
| 4,823,690 | 4/1989 | Stotz | 100/170 X |
| 4,924,772 | 5/1990 | Schlunke et al. | 100/163 R |
| 4,986,177 | 1/1991 | Masek et al. | 100/170 X |

FOREIGN PATENT DOCUMENTS

| | | |
|---|---|---|
| 2772/64 | 8/1969 | Finland . |
| 42916 | 11/1970 | Finland . |
| 46542 | 4/1973 | Finland . |

*Primary Examiner*—Harvey C. Hornsby
*Assistant Examiner*—Stephen F. Gerrity
*Attorney, Agent, or Firm*—Nixon & Vanderhye

[57] ABSTRACT

An actuator (10*a*, 10*b*) for calender rolls (3, 4) in a machine calender connected on-line to a paper machine, wherein the actuator is situated between the calender frame (9) and support arms (11), which adjust the movable calender rolls (3,4), in order to load and unload the nips ($N_3$, $N_2$) formed by the calender roll (3, 4) in question and its counter roll (3, 2), and to lock the calender rolls (3, 4) to the top position (3', 4'). The actuator (10*a*, 10*b*) is of modular construction and consists of a movable frame (13), which forms the frame of the actuator, and which can be connected to the vertical side (9*c*) of the claender girders (9) so that the vertical position of the movable frame (13) can be adjusted. The actuator module is equipped with a double acting hydraulic cylinder (12), which is connected between the movable frame (13) and the support arms (11) of the calender rolls (3, 4) to load and unload the calender nips and to lift the rolls (3, 4) to the top position. The actuator pieces, with which the support arms (11) can be locked to a position where the calender rolls (3, 4) connected to them are in their top position (3', 4').

7 Claims, 4 Drawing Sheets

ACTUATOR OF MODULAR CONSTRUCTION FOR ROLLS OF A MACHINE CALENDER

The present invention relates to an actuator for calender rolls in a machine calender connected on-line to a paper machine. The actuator is situated between the calender frame and support arms or the like which adjust the movable calender rolls, in order to load and unload the nips formed by the calender roll in question and its counter roll, and to lock the calender rolls to their top position.

As known, the machine calender is situated at the end of the paper machine to calender, in on-line mode, the web that comes from the paper machine. Prior art machine calenders have a calender stack formed by hard calender rolls, wherein there are several calender nips on top of each other in the calender stack, through which nips the calendered web has been led to run in a winding manner.

Various running modes are used in prior art machine calenders, e.g. the so-called two-roll, three-roll and four-roll runs are used in a four-roll calender (FIGS. 1A-1C). There are various actuators in the machine calender for choosing the running mode and for loading and unloading the calender nips, with which actuators the nips are loaded, unloaded, opened and locked. One such actuator, which is commonly used, is equipped with pneumatic bellows for the vertically moving calender rolls for loading and unloading the nips, and inside the calender there are vertical lifting rods, with which the calender rolls suspended from the swing arms can be transferred to the top position and the nips can be opened and locked.

Such pneumatic bellows require a relatively large space horizontally, especially when high nip pressures are used in the calender nips. The prior art actuators are difficult to use e.g. in connection with roll change, when the adjusting nuts mounted on the vertical lifting rods have to be turned to another position, because the radii of calender rolls vary, as is known.

The general object of the present invention is to provide a new actuator for calender rolls, which does not exhibit the aforementioned shortcomings.

The general object of the present invention is to further develop the prior art lifting, loading, unloading and locking devices of calender rolls in a machine calender, which devices are in the following commonly referred to as "actuators".

A further object of the invention is to provide an actuator which enables various running modes of a machine calender, and speeds up roll changes and the changes in the operating mode between them, in a more flexible manner than prior art.

A further object of the invention is to provide an actuator which is easy to mount, change and maintain, so that, as far as this device is concerned, the calender will cause as little down-time in the paper making process as possible e.g. in connection with the change of a calender roll.

A further object of the invention is to provide an actuator into which the lifting, loading, unloading and locking operations of calender rolls can be integrated using a simple and reliable construction. A further object of the invention is to provide an actuator which is of modular construction, so that its size and weight are reasonable and that it can be stored as a spare part in one unit.

In order to accomplish the aforementioned and the later mentioned objects, the principle features of the invention are:

that the actuator is of modular construction, consisting of a movable frame, wherein the movable frame can be mounted to the vertical side of the calender girders so that the vertical position of the movable frame can be adjusted;

that the actuator module has a double-acting hydraulic cylinder, which is mounted between the movable frame and the support arms of calender rolls to load and unload the calender nips and to lift the rolls to the top position; and that the actuator module consists of securing devices, with which the support arms can be locked to a position where the calender rolls connected to the support arms are in the top position.

In accordance with the invention, the actuator is of modular construction, and it can be changed quickly and moved to exactly the correct height e.g. in connection with the change of a calender roll. The actuator module of the invention can easily be stored as spare part. The loading, opening and locking operations of the nip are integrated into the actuator of the invention. In addition, the construction of the actuator is simple, reliable, requires relatively little space horizontally, and has a moderate weight.

Because of the modular construction and compact form, the manufacture and storage of the actuator of the invention can be organized economically. In addition, almost all expensive inner machining of frames can be avoided.

Next, a detailed account of the invention is given by reference to some application examples presented in the figures of the accompanying drawings. However, it is to be understood that the invention is by no means limited to the details given in the examples.

DETAILED DESCRIPTION OF THE DRAWINGS

Figure 1:
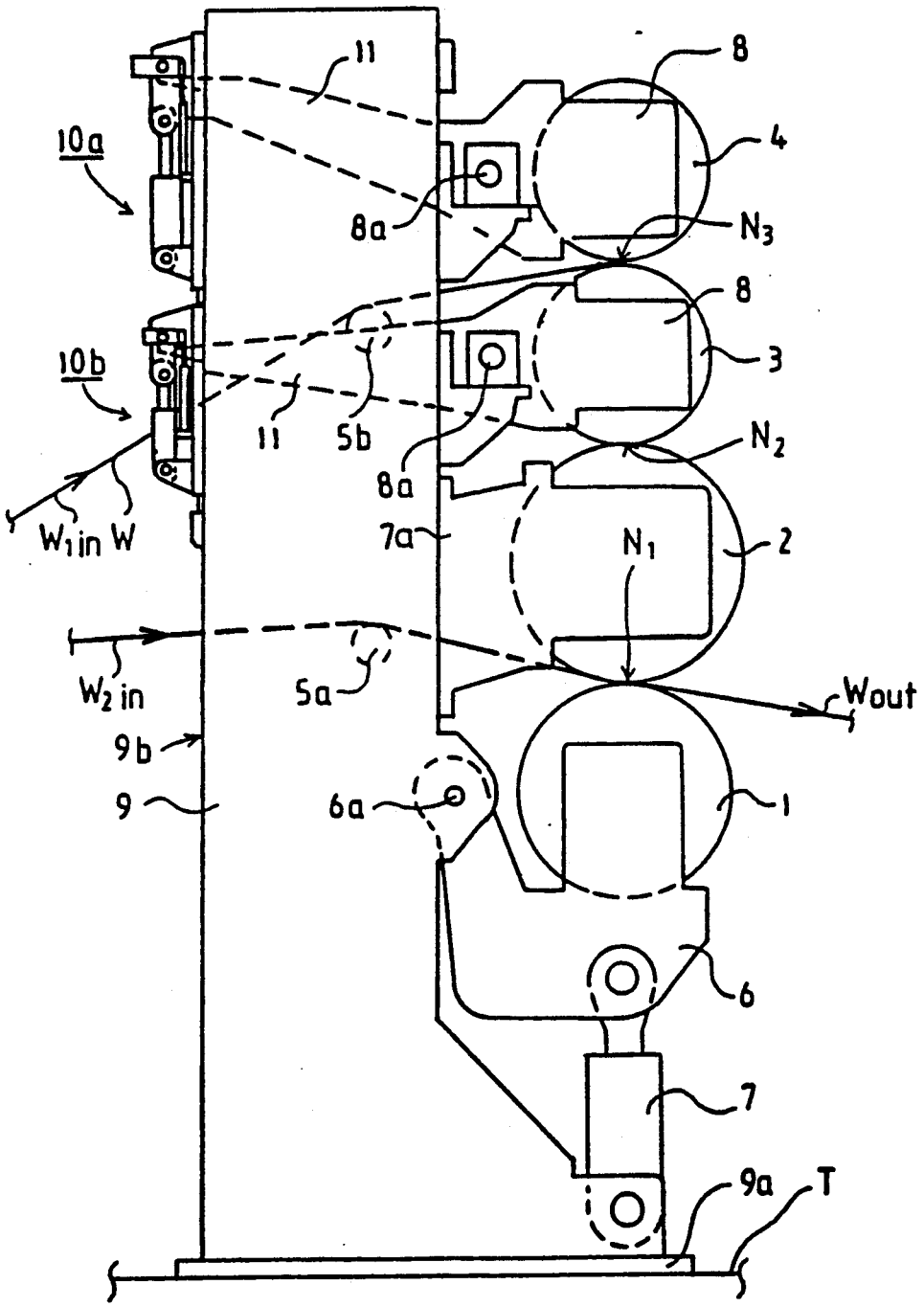
FIG. 1 schematically illustrates in side view a machine calender equipped with actuators in accordance with the invention.
Figure 1A:
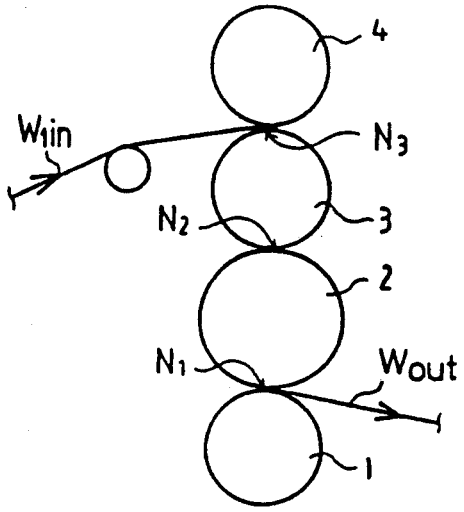
FIG. 1A illustrates the position of calender rolls and the run of the web in the so-called four-roll run in a machine calender presented in FIG. 1.

Firstly, the general structure of an on-line machine calender, which is mostly already known, is described as background of the invention, making reference to FIG. 1. The machine calender presented in FIG. 1 consists of a calender stack with four hard calender rolls 1, 2, 3 and 4, one on top of the other. The calender rolls are for example steel rolls which, with each other, form three hard calender nips $N_1$, $N_2$ and $N_3$. The paper web W coming from the paper machine (not illustrated) is led in four-roll run, as illustrated in FIG. 1A, through all nips $N_1$, $N_2$ and $N_3$, wherein the web W comes from the direction $W_{1in}$ over the spreader roll 5b to the top nip $N_3$, and goes around rolls 2 and 3 through the nip $N_2$ to the last nip $N_1$, from where it leaves in the direction $W_{out}$.

The bottom roll 1 of the calender stack is mounted in bearings from both ends by means of its shaft journals to bearing supports 6, which are joined onto the calender frame 9 with pivot pins 6a. The bottom roll 1 and its bearing supports 6 can be adjusted by means of hydraulic cylinders 7. The second roll 2 is mounted in bearings to the vertical side of the frame 9 with bearing supports 7a, which are stationary. The third roll 3 is mounted in bearings to its bearing supports 8, which are fastened to support arms 11. The support arms 11 are joined onto the frame 9 with pivot pins 8a. The top roll 4 is supported in the same manner as roll 3. The calender frame 9 is supported to the foundations T of the machine hall by means of its pedestal 9a. Actuator modules 10a and 10b of the invention, with which calender rolls 3 and 4 can be lifted and nips $N_2$ and $N_3$ can be loaded and unloaded, are mounted to the vertical side 9b on the opposite side of the calender frame 9 in relation to the calender stack 1, 2, 3 and 4. As illustrated in FIG. 1C, rolls 3 and 4 can be locked with the same actuator 10a, 10b to their top positions 3' and 4' in the so-called two-roll run, where only the bottom nip $N_1$ between rolls 1 and 2 is operating. In this case the bottom nip $N_1$ is loaded by hydraulic cylinders 7 by means of their bearing supports 6.

Figure 1B:
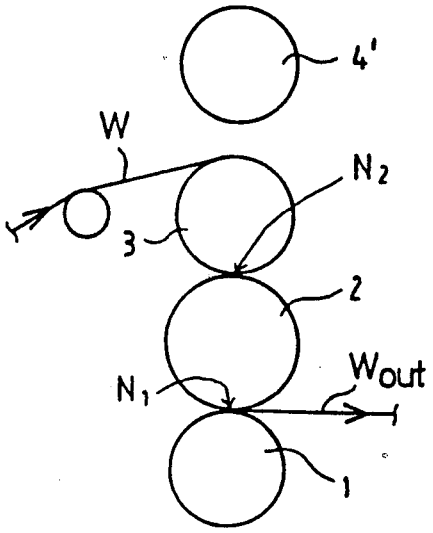
FIG. 1B illustrates the so-called three-roll run in the same manner as FIG. 1A.
Figure 1C:
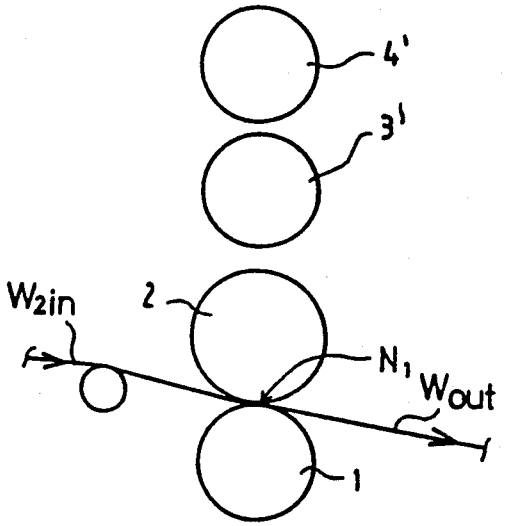
FIG. 1C illustrates the so-called two-roll run in the same manner as FIGS. 1A and 1B.

The top actuator module 10a of the invention can lift and lock only the top roll 4 to the top position 4' illustrated in FIG. 1B, in which case the bottom actuator module 10b loads or unloads the second nip $N_2$ in the so-called three-roll run.

In the following, reference 10 is used to mean references 10a and 10b together or alternatively.

Next, the construction and operation of the actuator 10 of the invention is described by reference to FIGS. 2A, 2B, 3 and 4.

Figure 3:
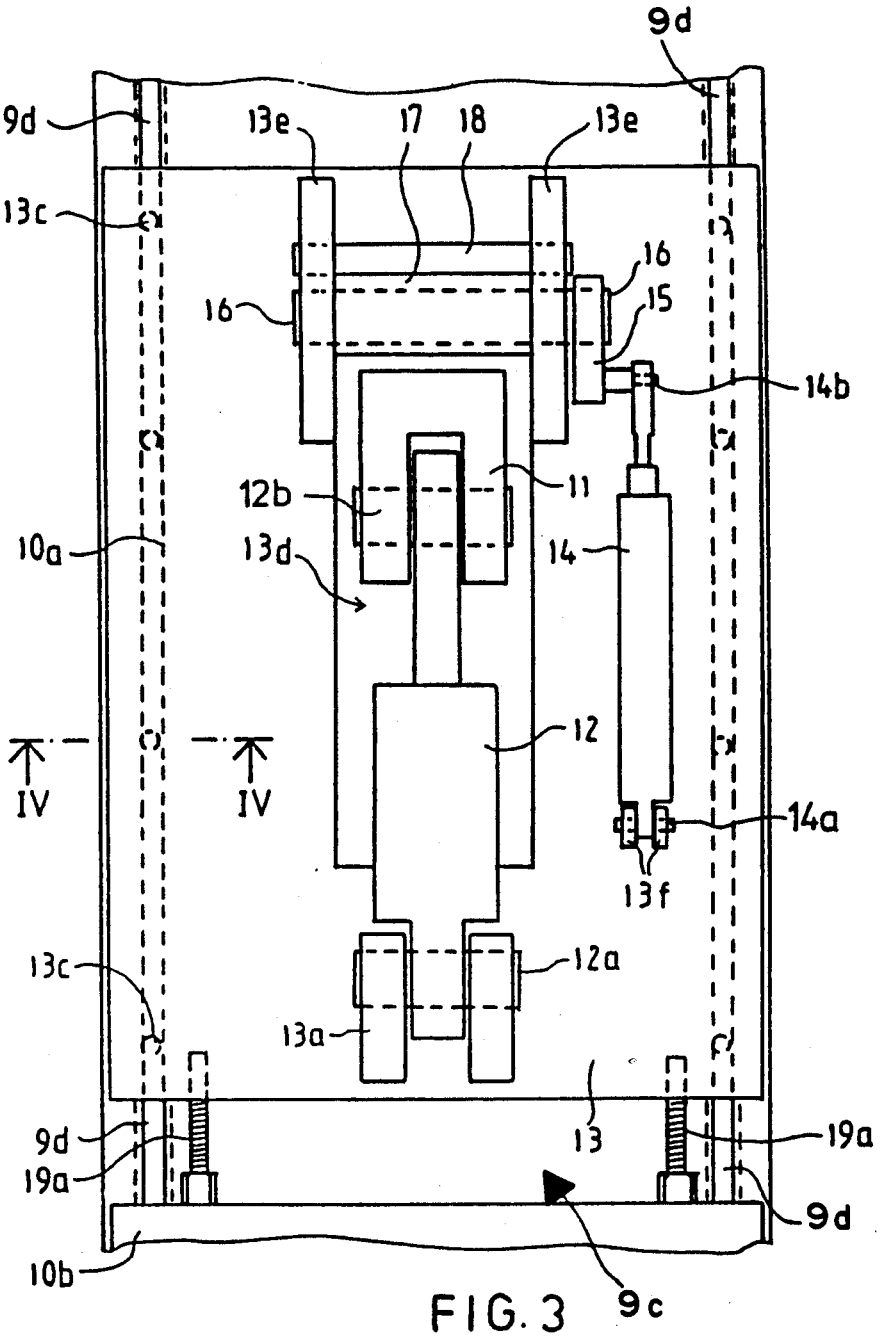
FIG. 3 illustrates the same as FIG. 2A, seen from the machine direction.
Figure 4:
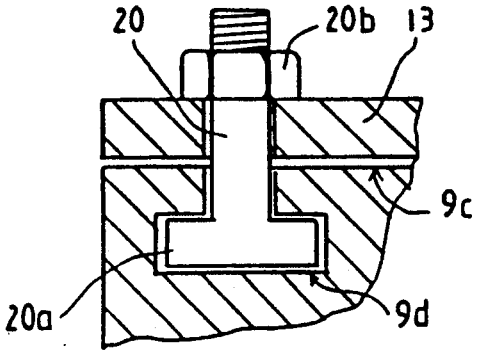
FIG. 4 illustrates the section IV—IV in FIG. 3.

The bearing supports 8 of top calender rolls 3 and 4 are mainly fastened to horizontal support arms 11, the outer ends of which are connected to hydraulic cylinders 12, which are double acting. The piston rod of the hydraulic cylinders 12 is connected to the support arms 11 with pivot pins 12b. The hydraulic cylinders 12 are connected from their other end to flanges 13a with pivot pins 12a, and the flanges 13a are fastened to the movable frame 13, which forms the frame of the actuator 10. Both edges of the movable frame 13 have a vertical line of holes 13c, under which there are vertical grooves 9d on the vertical side 9c of the frame 9. Screws 20 fasten the movable frame 13 to the calender frame 9 by means of grooves 9d, wherein the screws 20 have t-heads 20a and nuts 20b so that the actuator modules 10 can be adjusted to different heights onto the frame 9 e.g. in connection with the change of calender rolls 3 and 4. It is known that the diameters of calender rolls can vary within a certain range, in which case the actuator 10 has to be placed in exactly the correct height determined by its roll diameter. Screws 19a, which are illustrated in FIG. 3 and which are supported to the top side of the bottom actuator 10b, or to some other support part, can preferably be used to adjust the vertical position of the actuator 10.

In the actuator 10 of the invention, a double acting hydraulic cylinder is used as a loading device so that adequate forces can be achieved. The hydraulic cylinders 12 are situated in a preferred manner vertically so that they take up only a relatively small space. The double acting hydraulic cylinders 12 are used because they can be used for lifting the calender rolls 3 and 4 to the top position 3' and 4', and, in addition, the nips of the calender rolls can be loaded and unloaded with the same hydraulic cylinders so that an adequate linear pressure from the point of view of calendering is achieved in the calender nips.

Figure 2B:
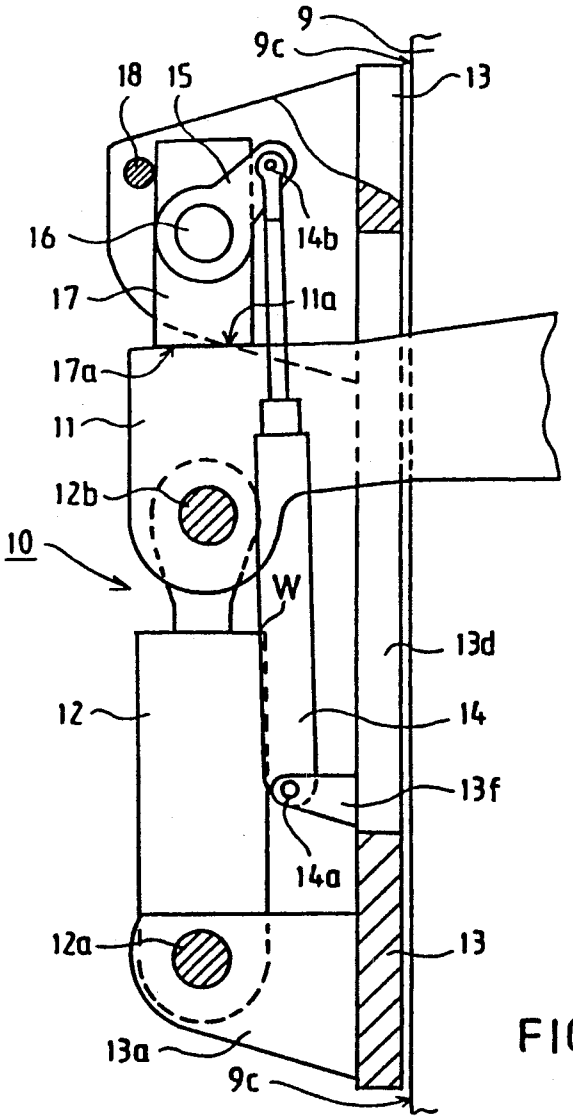
FIG. 2B illustrates the same actuator as FIG. 2A when the actuator is in the locked position, i.e. the roll is locked to the position nip open.
Figure 2A:
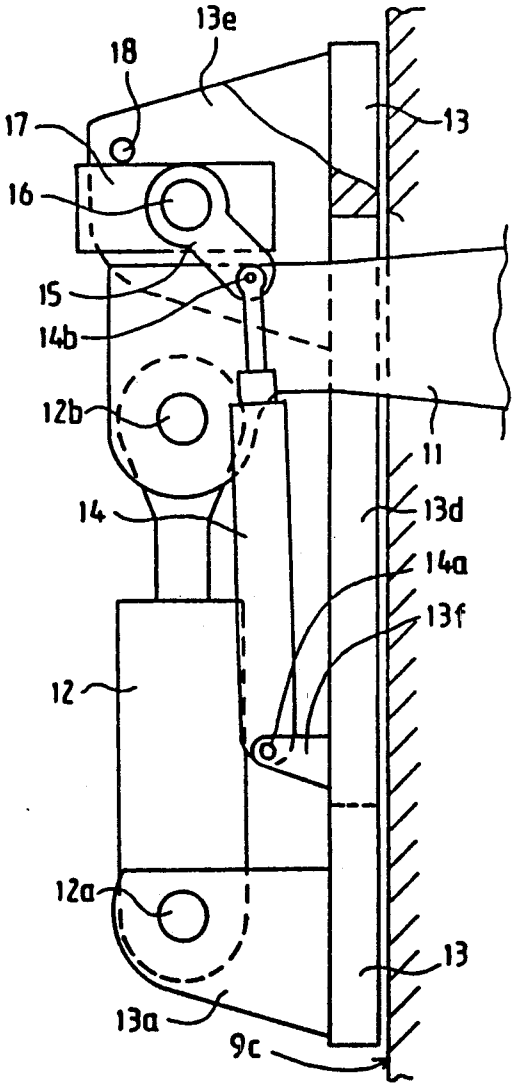
FIG. 2A illustrates in side view an actuator in accordance with the invention when the actuator is in the loading position, where the calender nip in question is closed.

As illustrated in FIGS. 2A and 2B, the movable frame 13 has an opening 13d, through which the support arm 11 projects. The actuator 10 has a securing piece 17, which is connected to the movable frame 13 with pivot pin 16 that runs between flanges 13e. At the other end of the pivot pin 16 there is a crank 15, which is connected to the piston rod of the double acting locking cylinder 14 with pivot pin 14b. The bottom end of the locking cylinder 14 is connected to the movable frame 13 with pivot pin 14a and flanges 13f. Between flanges 13e runs a rod 18, which positions the securing piece 17 both to the open position, which is illustrated in FIG. 2A, and to the locked position, which is illustrated in FIG. 2B.

As illustrated in FIG. 2B, the planar surface 17a of the securing piece 17 contacts the top planar surface 11a of the support arms 11 so that an even and adequately small contact pressure between faces 11a and 17a is achieved for the locking. In this case the top roll is locked to the position 4' and/or 5' (FIGS. 1B and 1C) as illustrated in FIG. 2B. The locking can be opened by using the locking cylinder 14 and by turning the securing piece 17 to the open position, as illustrated in FIG. 2A. After this, nip $N_2$ or nips $N_2$ and $N_3$ can be closed and loaded with hydraulic cylinders 12. If necessary, nips $N_2$ and/or $N_3$ can also be unloaded with adequate pressure led into the hydraulic cylinders 12.

FIGS. 2A and 2B illustrate and describe only the other side of the construction. Parts 6, 7, 8, 9, 11, 12 and actuator modules 10a and 10b described above belong both to the drive side and tending side of a calender.

The actuator modules 10a and 10b on top of each other differ from each other mainly as far as their vertical dimensions are concerned, because the bottom roll 3 requires a smaller margin for moving than top roll 4.

As many actuator modules 10a, 10b of the invention can be placed on top of each other as there are vertically adjustable calender rolls on top of each other in the calender stack, and there can be even more calender rolls than the two rolls 3 and 4 on top of each other illustrated in the figures.

Modifications and variations of the details of the invention different from the examples presented above are possible within the scope of the inventional concept defined by the following claims.

What is claimed is:

1. An actuator for at least one movable calender roll in a machine calender connected on-line to a paper machine, comprising:

at least a first movable frame connected to one vertical side of a stationary calender frame so that the movable frame can be adjusted along said one vertical side, said actuator further provided with a double acting hydraulic cylinder connected between said first movable frame and a first end of a support arm, said support arm pivotally connected at a second end to said at least one calender roll and pivotally connected between said first and second ends to said stationary calender frame, said cylinder operable to move said at least one calender roll to a raised position; wherein said at least one movable frame comprises a pair of substantially identical upper and lower movable frames and associated upper and lower cylinders and upper and lower support arms for supporting upper and lower calender rolls, said upper and lower movable frames connected to said one vertical side of said stationary calendar frame, one above the other, with vertical adjustment means therebetween.

2. The actuator of claim 1 and including a locking element for locking each support arm of each actuator module in the raised position.

3. An actuator as claimed in claim 2, wherein the locking elements each consist of a locking piece, mounted on a pivot pin so that it can be turned into connection with the movable frame of the actuator, and wherein said locking piece can be turned to an open position and to a closed position, by an actuating element, wherein in the locked position, said support arm becomes locked with the calender roll in the raised position.

4. An actuator as claimed in claim 3, wherein the locking piece has a planar surface which forms a counter face for locking together with a planar surface of a respective support arm, and wherein a rod is connected between a pair of support flanges which mount said pivot pin of said locking piece, said rod determining the open position and the locked position of the locking piece, and wherein a crank is fastened to said pin, said crank connected to one end of a locking cylinder, another end of the locking cylinder connected to said first movable frame of the actuator.

5. An actuator as claimed in claim 4, wherein said double acting hydraulic cylinder is oriented substantially vertically, and wherein a piston rod at one end of the hydraulic cylinder is pivotally connected to the support arm, and wherein an opposite end of the hydraulic cylinder is pivotally connected between a pair of flanges projecting from the movable frame.

6. The actuator of claim 1 wherein said upper and lower calender rolls comprise two adjacent and uppermost rolls in a stack of four rolls, and wherein each of said upper and lower calender rolls are supported by a pair of said movable frames, a pair of said double acting hydraulic cylinders and a pair of said support arms, and wherein each of said two adjacent uppermost rolls may be selectively raised to facilitate loading and unloading of first and second nips created by said two adjacent uppermost rolls and one other of said stack of four rolls.

7. An actuator for at least one movable calender roll in a machine calender connected on-line to a paper machine, comprising:

at least a first movable frame connected to one vertical side of a stationary calender frame so that the movable frame can be adjusted along said one vertical side, said actuator further provided with a double acting hydraulic cylinder connected between said first movable frame and a first end of a support arm, said support arm pivotally connected at a second end to said at least one calender roll and pivotally connected between said first and second ends to said stationary calender frame, said cylinder operable to move said at least one calender roll to a raised position; wherein said movable frame is secured to said one vertical side of said stationary calender frame by means of fasteners engageable within selectively usable mounting holes provided in a pair of grooves formed on said one vertical side of said stationary calender frame so that the vertical position of said movable frame can be adjusted.

* * * * *